United States Patent [19]

Wilson et al.

[11] 4,346,543

[45] Aug. 31, 1982

[54] BUILDING INSULATION SYSTEMS

[75] Inventors: Keith E. Wilson; Phillip W. Blackmore, both of Camlachie, Canada

[73] Assignee: Fiberglas Canada, Inc., Toronto, Canada

[21] Appl. No.: 161,494

[22] Filed: Jun. 20, 1980

[30] Foreign Application Priority Data

May 8, 1980 [CA] Canada ..... 351511

[51] Int. Cl.[3] ..... E04B 1/74

[52] U.S. Cl. ..... 52/404; 52/410; 52/483

[58] Field of Search ..... 52/404, 407, 410, 483, 52/408, 732, 309.8

[56] References Cited

U.S. PATENT DOCUMENTS

| | | | |
|---|---|---|---|
| 3,662,509 | 5/1972 | Studzinski | 52/404 |
| 4,014,150 | 3/1977 | Wells et al. | 52/461 |
| 4,044,521 | 8/1977 | Fischer et al. | 52/404 |
| 4,052,831 | 10/1977 | Roberts et al. | 52/309.8 |
| 4,117,641 | 10/1978 | Wells | 52/404 |
| 4,117,642 | 10/1978 | Eckert et al. | 52/486 |
| 4,233,791 | 11/1980 | Kuhl et al. | 52/404 X |
| 4,251,972 | 2/1981 | Interlante | 52/404 X |
| 4,263,763 | 4/1981 | Bouwens | 52/404 |

FOREIGN PATENT DOCUMENTS

| | | |
|---|---|---|
| 734139 | 5/1966 | Canada . |
| 858167 | 12/1970 | Canada . |

*Primary Examiner*—Carl D. Friedman

*Attorney, Agent, or Firm*—Birch, Stewart, Kolasch & Birch

[57] ABSTRACT

A metal building insulation system facilitates the installation of insulation in the roof and walls of a building from the exterior of the building and employs channel members fitted over outwardly facing flanges on the structural members from the exterior of the building, the channel members having opposed side walls for receiving the structural members therebetween and intermediate walls connecting the side walls. At least one layer of insulating material is retained between successive structural members by means of projections extending outwardly from the side walls of the channel members and inwardly facing flanges on the structural members.

14 Claims, 13 Drawing Figures

BUILDING INSULATION SYSTEMS

FIELD OF THE INVENTION

The present invention relates to building insulation systems for use, for example, in buildings comprising metal structural members having a cladding in the form of metal roof and/or wall sheeting or panelling.

BACKGROUND OF THE INVENTION

During the construction of a metal building, it is normal firstly to construct a framework of metal structural members, including purlins and wall girts, and then to provide this framework with heat insulation and a cladding before casting a concrete floor in the building. Consequently, the ground on which the building is being erected is often obstructed by rubble and the like. For this reason, it is preferred to apply the insulation and the cladding from the exterior of the building framework.

In the past, the insulation and cladding has normally been applied to the building framework by firstly positioning a blanket of glass fibre insulation material, provided with a vapour barrier facing, over the exterior of the roof purlins and wall girts of the building framework, and then securing the cladding at the exterior side of the glass fibre insulation material. The securing of the cladding has normally been effected by means of screws inserted, from the exterior of the building, through the cladding and the glass fibre insulation material and into threaded engagement with the purlins and girts. These screws are provided with compressive washers for sealing screw holes in the cladding, and the screws must be tightened sufficiently to compress the washers for preventing the ingress of moisture through the screw holes.

Such tightening of the screws causes compression of the glass fibre insulating material between the cladding and the purlins or girts, which substantially reduces the heat insulating properties of the glass fibre insulating materials at the compressed portions thereof, relative to the uncompressed portions.

OBJECTS OF THE INVENTION

It is accordingly an object of the present invention to provide a novel and improved building insulation system which facilitates the installation of insulating material and building cladding material onto a building framework from the exterior of the building framework.

BRIEF SUMMARY OF THE INVENTION

According to the present invention, there is provided a metal building insulation system, comprising elongate metal structural members of a building frame spaced apart from one another in mutually parallel relationship; the structural members each having a flange at the outermost sides of the respective structural member; the flanges each having an outer face directed outwardly of the building frame; at least one layer of heat insulating material extending between the structural members; and means for retaining the heat insulating layer relative to the structural members; the retaining means comprising channel members receiving the flanges; and the retainer members each comprising an intermediate portion located outwardly of and extending across the respective one of the outer faces, a pair of side walls projecting inwardly from opposite longitudinal sides of the intermediate portion and a retainer projection extending laterally of the respective structural member from at least one of the side walls and located inwardly of the heat insulating layer, whereby the retainer members can be installed on the structural members from the exterior of the building frame.

In one embodiment of the invention, each channel member has a pair of the retainer projections extending from opposite sides of the channel member and both serving to retain the heat insulating layer.

In another embodiment, each channel member is provided with only one retainer projection, which is substantially co-planar with an inwardly facing inner flange on the respective structural member, and in this case the heat insulating layer is retained by the retainer member at one side of the structural member and by the inner flange at the other side of the structural member. With this arrangement, the heat insulating layer is level at the opposite sides of the structural member and substantially flush with the inwardly directed face of the inner flange and therefore presents a neat appearance.

During the assembly of the building, the channel members are fitted around the structural members, with the intermediate portions of the channel members outside the outermost faces of the outer flanges of the structural members, and the insulating material layer is then fitted between the structural members, so that a cladding can subsequently be secured to the structural members, through the channel member intermediate portions, with the insulating material layer retained between the retainer projections and the cladding. Consequently, there is available between the projections and the cladding a space this is sufficient to accommodate the thickness of the insulating material layer, so that the latter is not compressed between the structural members and the cladding.

If desired, a thermal break in the form of strips of heat insulating material may be provided between the intermediate portions of the channel members and the cladding, in which case the strips are preferably made of an insulating material which is relatively hard to resist compression of the strips on attachment of the cladding to the structural members by screws.

The invention will be more readily understood from the following description of preferred embodiments thereof given, by way of example, with reference to the accompanying drawings, in which.

Figure 1:
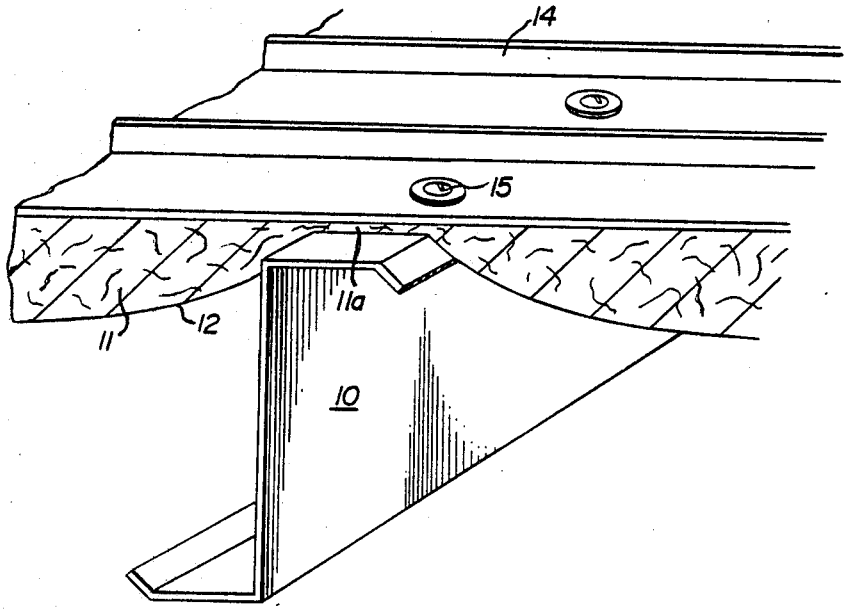
FIG. 1 shows a broken-away view in perspective of a prior art roof insulation system.
Figure 7:
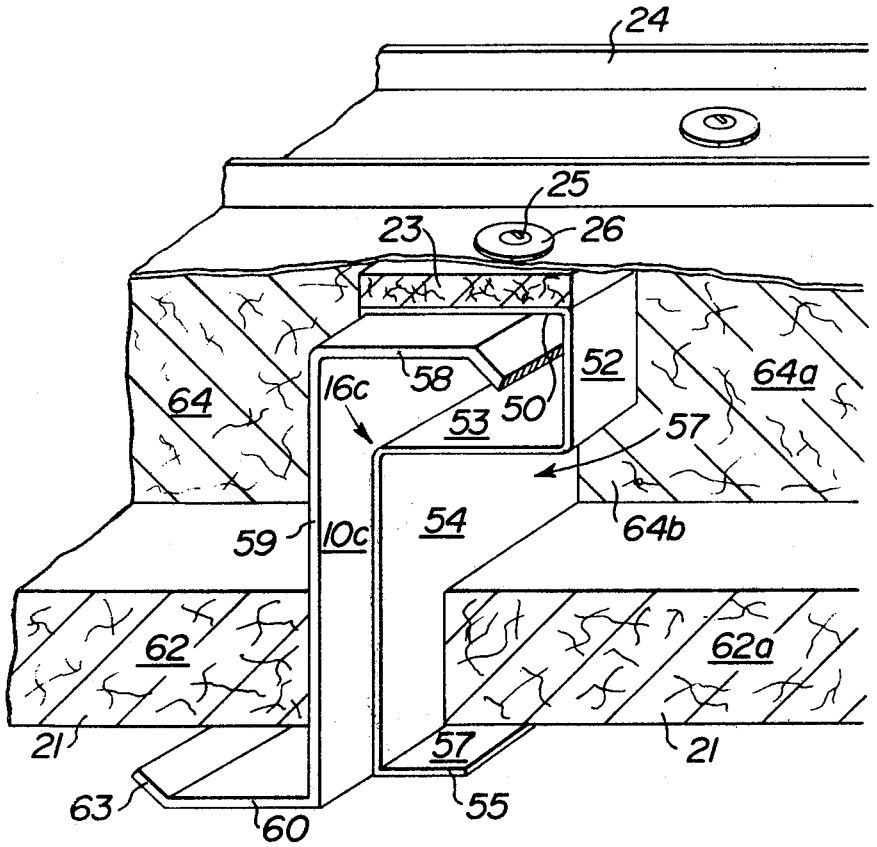
FIG. 7 shows a view corresponding to FIG. 1 but illustrating a further embodiment of the invention.
Figure 7A:
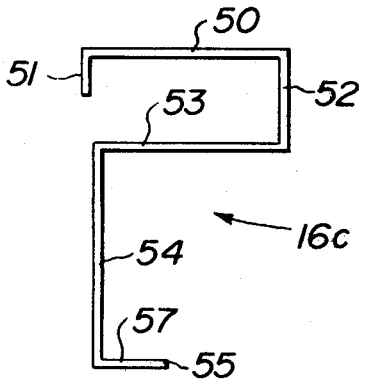
Figure 9:
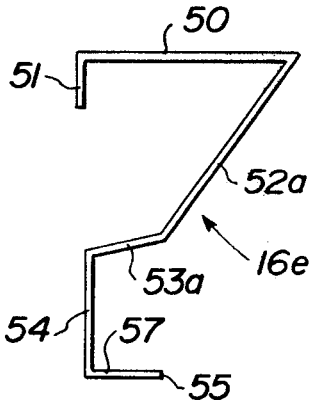
Figure 10:
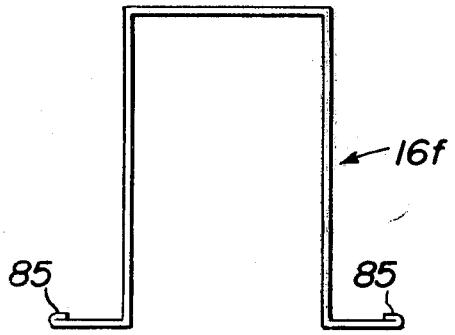
Figure 11:
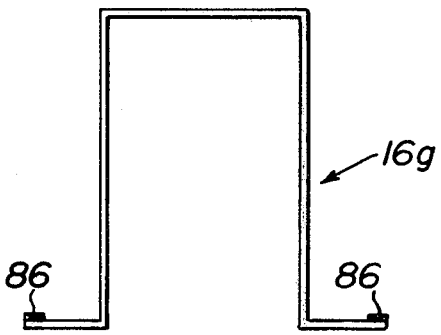
Figure 8:
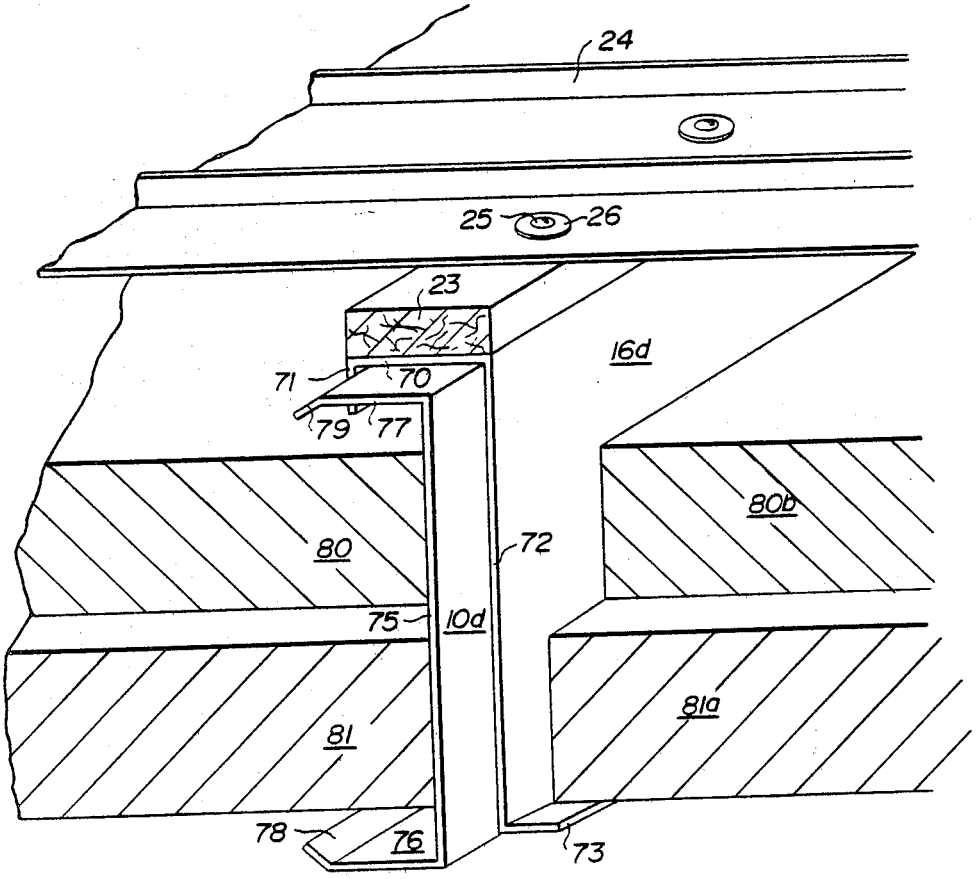

FIG. 7*a* shows an end view of the retainer member of the embodiment of FIG. 7;

FIG. 8 shows a view corresponding to FIG. 1 but of a still further embodiment of the present invention; and FIGS. 9, 10 and 11 show end views of further retainer members.

Referring firstly to the prior art system illustrated in FIG. 1, there is shown a roof purlin 10 which, in a conventional metal buiding framework (not shown), is one of a plurality of such purlins extending horizontally and parallel to one another to form parts of a roof.

A layer of glass fibre insulation material 11 extends over the top of the purlin 10, the glass fibre insulation 11 being provided with a facing in the form of a vapour barrier 12, as is well known in the art.

Metal roof sheeting 14 is provided on the top of the glass fibre insulation 11 and is supported by the purlin 10, to which it is secured by screws 15 extending through the glass fibre insulation 11 into threaded engagement with the purlin 10.

The screws 15 are provided with compressible washers (not shown) for sealing screw holes (not shown) in the sheeting 14 in order to prevent the ingress of moisture through the screw holes into the interior of the building.

To ensure sufficient compression of these washers to provide satisfactory sealing of the screw holes, the screws 15 must be sufficiently tightened into tight threaded engagement with the purlin 10.

This tightening of the screws 15 causes the glass fibre insulation 11 to be compressed at a portion 11*a* thereof where the glass fibre insulation 11 extends over the top of the purlin 10 and is tightly sandwiched between the purlin 10 and the overlying metal roof sheeting 14.

This compression of the glass fibre insulation portion 11*a* has the obvious disadvantage of reducing the heat insulation provided by this prior art insulating system, since heat can more readily escape from the interior of the building through the glass fibre compressed portion 11*a* than through the uncompressed portions of the glass fibre 11.

Figure 2A:
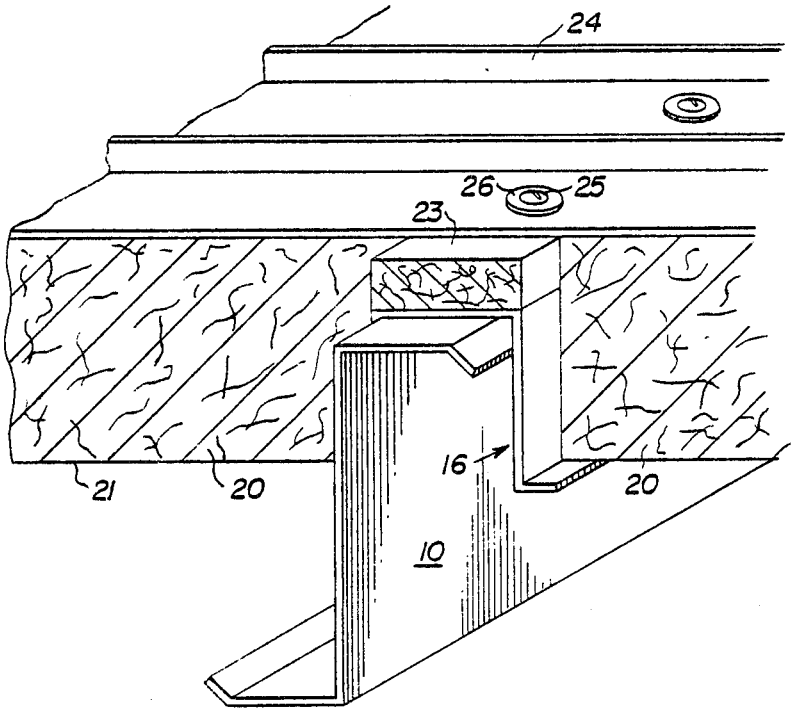
FIG. 2A shows a view corresponding to FIG. 1 but of a roof insulation system according to a first embodiment of the present invention.
Figure 2B:
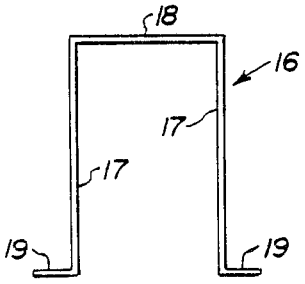
FIG. 2B shows an end view of a channel member employed in the system of FIG. 2A.

The embodiment of the present invention illustrated in FIG. 2A employs a generally U-shaped channel member indicated generally by reference numeral 16 and shown in end view in FIG. 2B.

The channel member 16 has a pair of opposed, parallel flat side walls 17, which are connected at one longitudinal extremity of each by a flat intermediate wall 18, which extends at right angles to the side walls 17. The opposite longitudinal extremities of the side walls 17 are provided with laterally outwardly extending projections in the form of flat longitudinal flanges 19, which are perpendicular to the respective side walls 17.

The side walls 17 are spaced apart from one another by a distance which is such as to receive the upper portion of the purlin 10 snugly therebetween, as shown in FIG. 2A, with the intermediate wall 18 seated in surface-to-surface contact with the top of the purlin 10.

Panels 20 of the semi-rigid building insulating material are supported on the flanges 19, the panels 20 being made of glass fibre board having a density in the range of 1.5 to 6.5 pounds per cubic foot.

The panels 20 are thus supported between mutually opposed outer faces of the channel members provided on successive ones of the purlins 10.

In practice, the longitudinal axes of successive purlins 10 are disposed at 5 feet spacings, although this distance is sometimes reduced to 4 feet, and the panels 20 must therefore be sufficiently rigid to preclude undue sagging of the panels 20 between the purlins.

More particularly, the panels 20 preferably have a resistance to sag such that they do not sag more than 1 inch between successive purlins.

Also, the undersides of the panels 20 are provided with a facing 21 forming a vapour barrier, which may for example comprise a vinyl layer, a scrim reinforced vinyl provided with a layer of aluminum foil, a scrim reinforced vinyl provided with a layer of aluminized polyester, a fire resistant kraft sheet provided with a scrim or any other suitable vapour barrier, as will be readily apparent to those skilled in the art.

The panels 20 have edge surfaces which face the outer surfaces of the side walls 17 and preferably which extend upwardly beyond the side walls 17 and the intermediate walls 18 so as to define a gap between adjacent panels 20 above the respective purlin 10.

To oppose the escape of heat through this gap, a thermal break in the form of a strip of heat insulating material 23 is inserted into this gap and supported on the top of the intermediate wall 18.

A cladding in the form of a metal roof sheeting 24 is provided over the insulating matrial panels 20 and the insulating material strip 23 and is secured to the pulin 10 by screws 25, which extend through screw holes in the metal roof sheeting 24 and the intermediate wall 18, and also through the insulating material strip 23, into threaded engagement with the purlin 10.

The screws 25 are provided with washers 26 of compressible material to provide a moisture seal between the screws 25 and the metal sheeting 24 and, in order to prevent undue compression of the insulating material strips 23 during tightening of the screws 25, the insulating material strip 23 is provided with a relatively high compressive strength. More particularly, it has been found in practice that the insulating material strip 23 should preferably be made of a material having a compressive strength of 30 pounds per square inch or greater at 5 percent deformation. Commercially available insulating material, such as, for example, polystyrene foam, may be employed for this purpose.

As will be readily apparent from consideration of FIG. 2A in the light of the above description, the channel member 16 and the insulating strip material 23 provide, between the flanges 19 and the metal sheeting 24, a relatively large space for receiving edge portions of the insulating material panels 20, without compressing the material of the panels 20, or with an acceptably small compression of the edge portions of the panels 20, so that the heat insulation provided by the panels 20 is not reduced adjacent the channel member 16 by compression of the edges of the panels 20.

Also, the insulating material strip 23 provides the thermal break between the purlin 10 and the metal sheeting 24.

Figure 3:
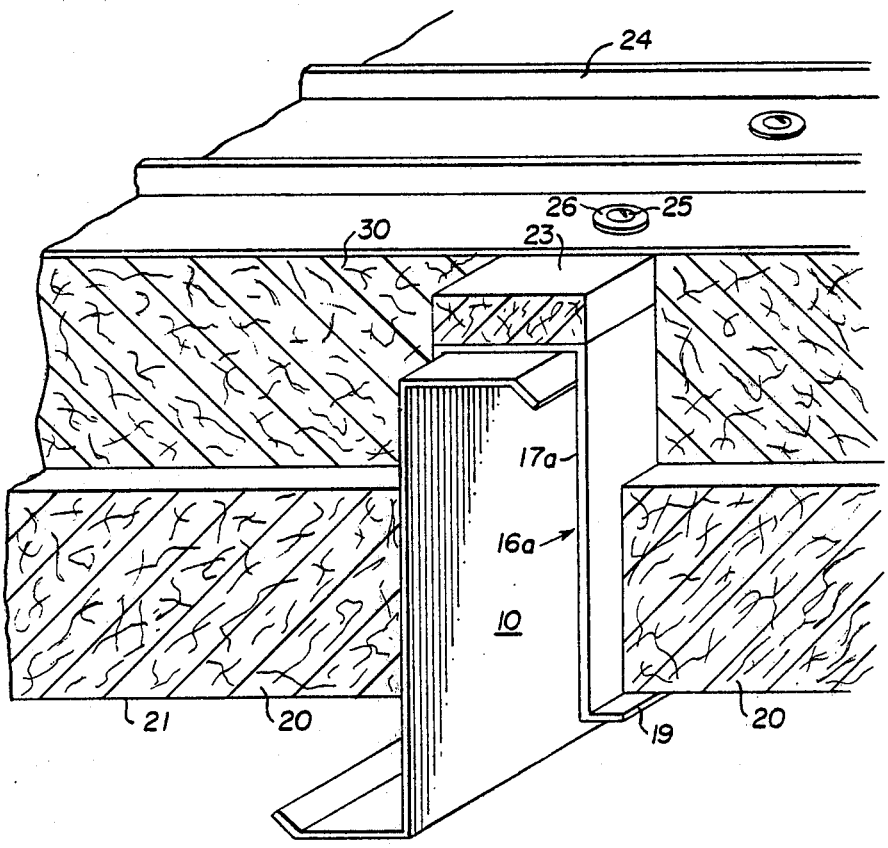
FIG. 3 shows a view corresponding to FIG. 2A but of a modified insulation system according to a second embodiment of the present invention.

The modified building insulation system illustrated in FIG. 3 employs a channel member 16*a* which is generally similar to the channel member 16 of FIG. 2A but, in comparison thereto, has deeper side walls 17*a*.

The purpose of the deeper side walls 17*a* is to provide a greater spacing between the flanges 19 and the metal sheeting 24, and thereby to accommodate an additional layer of insulation, in the form, for example, of glass fibre batts 30, between the insulating material panels 20 and the metal sheeting 24.

In this case, the panels 20 should have a sufficient resistance to sag to ensure that the maximum sag in the panels 20 between succeeding purlins 10 is once again not more than 1 inch, despite the fact that the glass fibre batts 30 are supported on the insulating material panels 20.

The remaining components of the insulation system illustrated in FIG. 3 are similar to those which have already been described above with reference to FIG. 2A, and are accordingly indicated by the same reference numerals.

Figure 4:
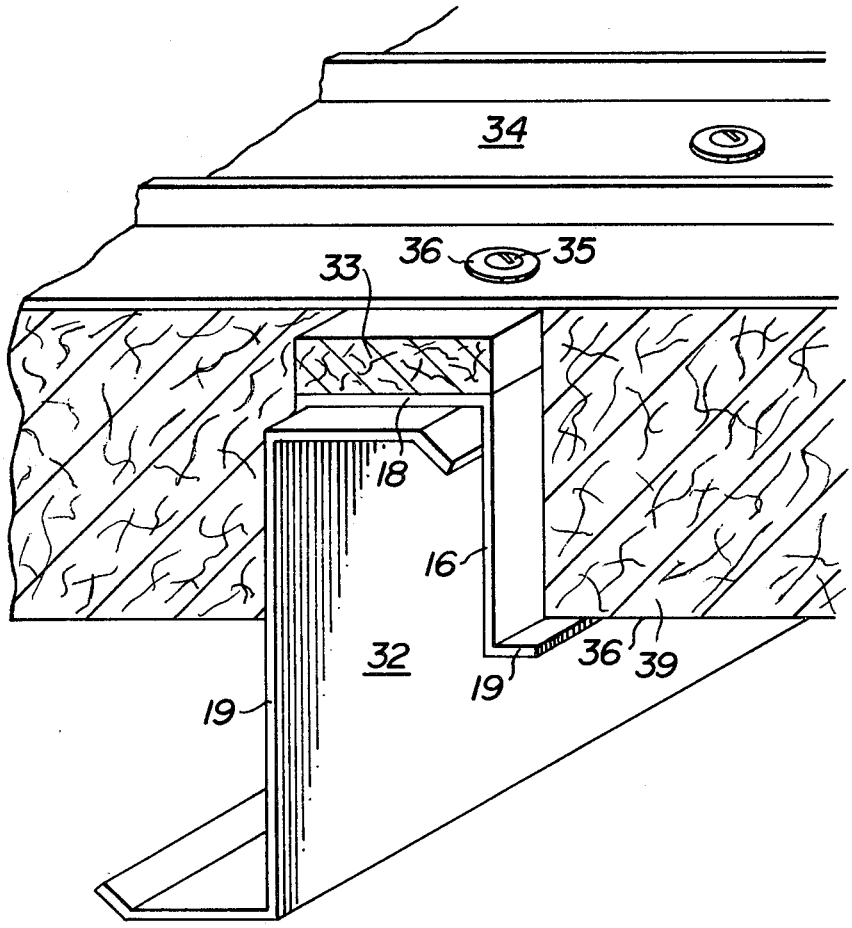
FIG. 4 shows a broken-away view in perspective of part of a wall insulation system similar to the system of FIG. 2A.

FIG. 4 shows a wall insulation employing the channel member 16.

More particularly, in FIG. 4, the channel member 16 is shown fitted over a wall girt 32, with a strip 33 of insulating material interposed between the intermediate wall 18 of the channel member 16 and a wall cladding in the form of a wall sheeting or panelling 34.

Screws 35, provided with compressible washers 36, extend through screw holes in the panelling 34 and the intermediate wall 18, and through the insulating material strip 33, into threaded engagement with the girt 32 for securing the panelling 34 to the girt 32, and the insulating material strip 33, which may be made of the same material as the insulating material strip 23 of FIG. 3, is again provided with a relatively high compressive strength.

Insulating material panels 39, which may be of the same insulating material as the panels 20 of FIG. 2A and which are provided with vapour barrier facings 36 of, for example, the same material as the vapour barrier facings 21 of FIG. 2A, are retained in position adjacent the wall panelling 34 by the flanges 19 of the channel member 16.

It will therefore be apparent that the wall insulation system of FIG. 4 is similar to the roof insulation system of FIG. 2A.

Figure 5:
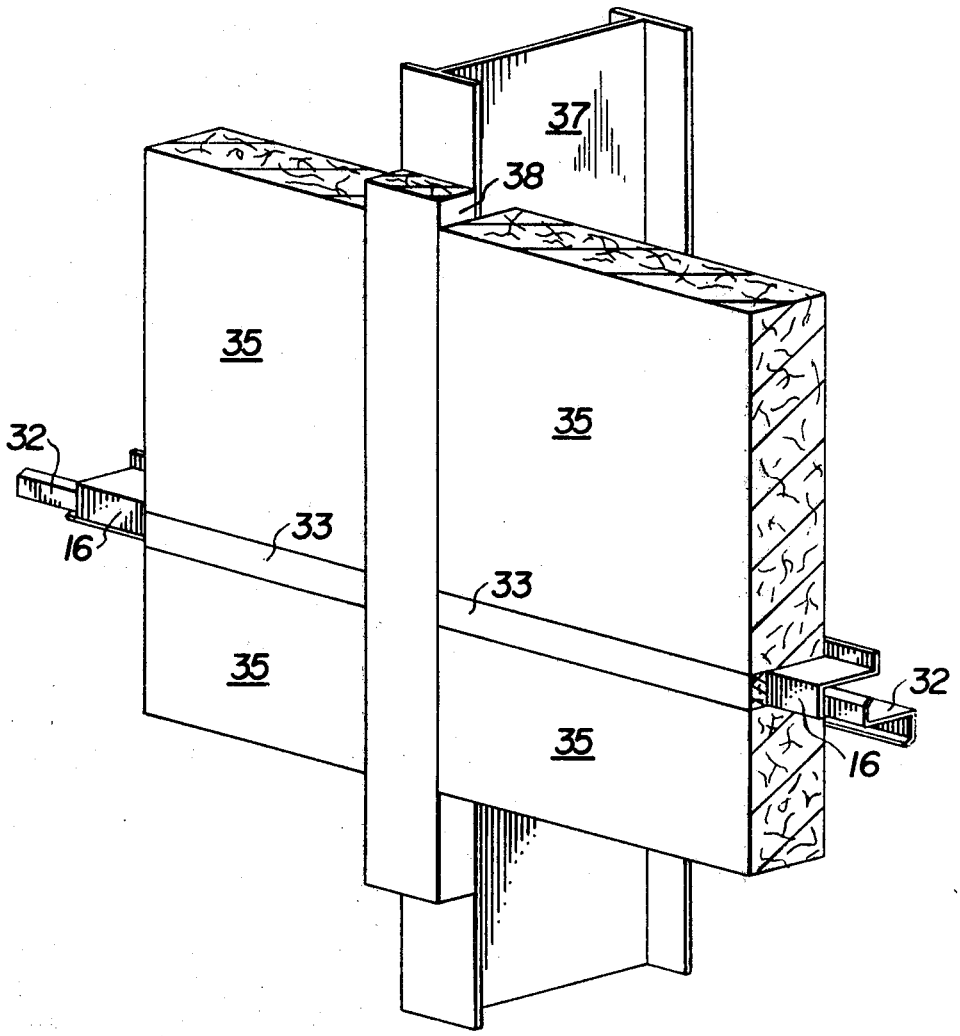
FIG. 5 shows a broken-away perspective view of the wall insulation system of FIG. 4.

The wall insulation system of FIG. 4 is also illustrated in FIG. 5, but with the wall panelling 34 omitted in order to show more clearly a plurality of the insulating material panels 39 and two of the insulating material strips 33.

In addition, FIG. 5 shows a vertical structural member 37 forming part of the building framework and an insulating material strip 38 provided on the structural member 37 between adjacent ones of the panels 39 to form a thermal break between the structural member 37 and the exterior of the building. The insulating material strip 38 is preferably made of the same material as the strips 33 and 23.

Figure 6:
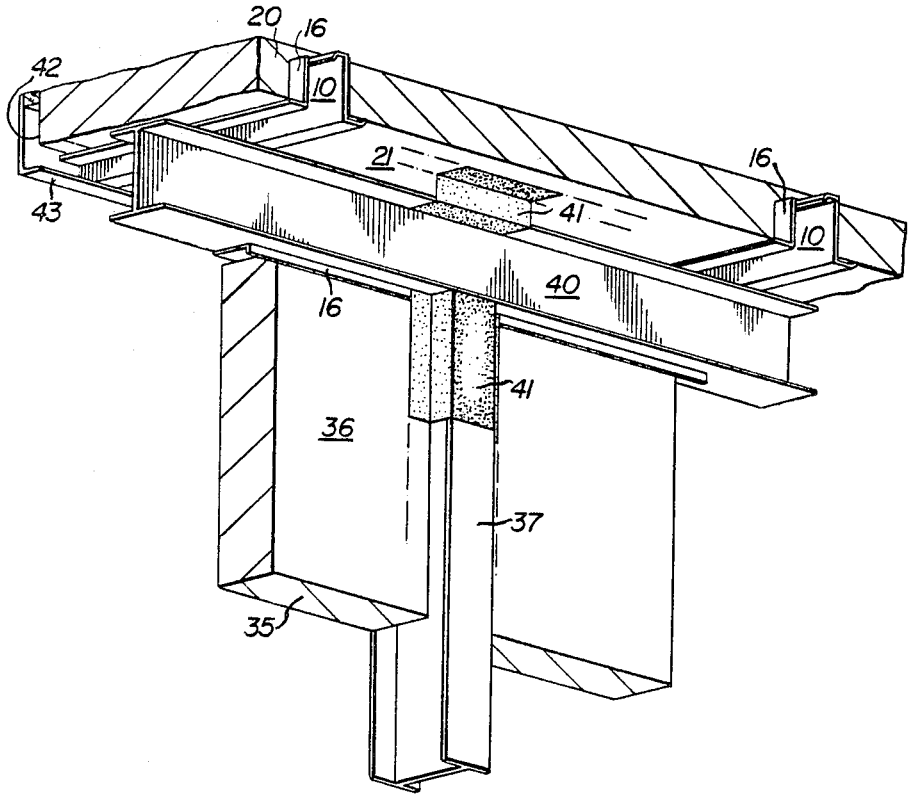
FIG. 6 shows a broken-away view, in perspective, of a building insulation system embodying the present invention

FIG. 6 shows a building insulation system combining the wall insulation system of FIGS. 4 and 5 and the roof insulation system of FIG. 2A but with the wall panelling 34 and the roof panelling 24 omitted.

As shown in FIG. 6, a pair of purlins 10 are supported on a generally horizontally extending structural member 40, with insulation panels 20 suspended from the purlins 10 by channel members 16, as described hereinabove.

In order to provide a vapour barrier across the gap formed between the vapour barrier 21 at the underside of each panel 20 and the structural member 40, and a vapour barrier between the structural member 37 and the vapour barrier facing 36 of the wall panels 35, strips 41 of tape of any material suitable for forming such a vapour barrier, such as the tape marketed under the Trade Name "ULTRALAM", are secured adhesively to the vapour barriers 21 and 36 and the structural members 40 and 37.

In addition, the roof insulating material panels 20 are supported by means of a generally S-cross-section elongate member 42 to a facia channel 43 mounted on the ends of the purlins 10.

In the embodiment of the invention illustrated in FIG. 7, in which the same reference numerals have been employed as in FIG. 2A to indicate the same parts, there is employed a further modified retainer member or channel member, indicated by reference numeral 16*c* which is shown in greater detail in FIG. 7*a*.

The channel member 16*c* has a flat top or outer wall 50, which along one edge thereof adjoins a relatively short side wall 51 and, at the opposite longitudinal edge thereof, a side wall which comprises a first portion 52, which is parallel to the side wall 51, a second portion 53, which extends parallel to the top 50 and perpendicular to the first portion 52, a third portion 54, which is parallel to the first portion 52 and the side wall 51, and a fourth portion 55, which is parallel to the second portion 53 and the top 50.

The second portion 53, the third portion 54 and the fourth portion 55 define a laterally open, U-shaped recess 57, the purpose of which is described hereinafter.

Referring again to FIG. 7, it will be seen that the top wall 50 of the channel member 16*c* is seated on the outer or top face of the top, horizontal flange 58 of a purlin 10*c*, which also comprises an intermediate web 59 and a bottom, inner horizontal flange 60.

The side wall 51 extends downwardly at one side of the intermediate web 59, and the first portion 52 of the channel member 16*c* extends downwardly at the outer side of the top flange 58, with the second portion 53 extending below the top or outer flange 58 and with the third portion 54 abutting the intermediate web 59. At one side of the purlin 10*c*, an insulation panel 62 is supported on the lower or inner flange 60, or more particularly on an upwardly inclined marginal edge portion 63 thereof, and a second, upper insulation panel 64 is supported on the upper surface of the panel 62.

At the opposite side of the purlin 10*c*, an insulation panel 62*a* extends into the recess 57 in the channel member 16*c* and is supported on the upper face of the fourth portion 55.

The panel 62*a* supports a further insulation panel 64*a*, which is formed with a laterally projecting marginal edge portion 64*b* projecting into the recess 57 between the panel 62*a* and the second portion 53, the panel 64*a* abutting the third portion 54 within the recess 57 and the first portion 52 above the recess 57.

As will be apparent to those skilled in the art, the embodiment of the invention illustrated in FIGS. 7 and 7*a* provides, in addition to the advantages of the hereinbefore described embodiments of the invention, the further advantage that the undersides of the adjacent lowermost or innermost panels 62 and 62*a* are substantially co-planar. Obviously, by reducing the height of the third portion 54 of the channel member 16*c*, the panel 62*a* can be raised, if required, to a height at which it is exactly co-planar with the panel 62.

The at least substantially, or entirely, co-planar relationship of the panels 62 and 62*a* has the aesthetic advantage of providing a ceiling surface which is at least substantially flat.

FIG. 8 shows a still further embodiment of the invention, in which the same aesthetic advantage is obtained.

In this case, the channel member, which is indicated by reference numeral 16*d*, comprises a flat, outer top wall or flange 70, adjoining along its opposite longitudinal edges a short side wall 71 and a relatively long side wall 72.

An inner flange or support portion 73 projects laterally from the lower edge of the side wall 72 and is parallel to the top portion 70 and perpendicular to the side wall 72.

Also, in this embodiment of the invention the purlin, indicated by reference 10*d*, comprises a flat, vertical intermediate wall or web portion 75 and inner and outer flanges 76 and 77 projecting horizontally from opposite longitudinal edges of the intermediate web 75 and at the same side of the intermediate web 75, the flanges 76 and 77 having inclined marginal edge portions 78 and 79.

The side wall 71 of the channel member 16*d* projects downwardly, past the outer flange 77 and marginal edge portions 79 of the purlin 10*d*, but terminates above the upper surface of an outer insulation panel 80, which rests on an inner insulation panel 81, which in turn is supported on the marginal edge portion 78 of the flange 76 of the purlin 10*d*.

The other side wall 72 of the channel member 16*d* extends down the side of the intermediate web 75 of the purlin 10*d* through a distance such that the flange or support portion 73 of the channel member 16*d* is substantially co-planar with the inner or lower flange 76 of the purlin 10*d*.

The flange or support portion 73 supports inner panel 81*a*, which in turn supports an overlying outer insulation panel 80*b*.

FIG. 9 shows, in end view, a modification of the channel member 16*c* of FIG. 7*a*, the channel member of FIG. 9 being indicated by reference numeral 16*e* and having a first side wall portion 52*a* which, unlike the first portion 52, is not parallel to the short side wall 51 but is inclined relative thereto and relative to the top or outer wall 50, and a second side wall portion 53*a*, which is also inclined relative to the top wall 50. Otherwise, as can readily be seen, the channel member 16*e* of FIG. 9 is substantially similar to the channel member 16*c* of FIG. 7*a*.

FIG. 10 shows a modification, indicated by reference numeral 16*f*, of the channel member 16 of FIG. 2B.

The channel member 16*f* is shaped similarly to the channel member 16 of FIG. 2B, but in addition has, along its longitudinal edges, rolled lips 85, which serve to reinforce the channel member 16*f*, to improve sealing action with the vapour barrier facing of the insulation panels and to present a smooth edge for handleability.

The channel member illustrated in FIG. 11, which is indicated generally by reference numeral 16*g*, is also similar to that of FIG. 2B, but is modified by the addition, along the tops of its marginal edge portions, of caulking or sealing strips 86.

In the above-described embodiments of the invention, the thickness of the roof and wall panels will, of course, depend upon the amount of insulation required, but will normally be within the range of 1 to 5 inches.

Instead of employing panels of semi-rigid glass fibre board, the panels may alternatively be replaced, for example, by gypsum board, to provide fire protection, and a rigid cellular plastic insulation, in which case a vapour barrier is preferably incorporated in the system using a vinyl facing or foil backing on the gypsum board or by the installation of a separate polyethylene film vapour barrier.

The above-described channel members are preferably made of galvanized carbonized iron or mild steel, or of, for example, stainless steel provided with a reddish metal oxide coating to match the purlins.

Alternatively, the channel members may be made of steel which is painted or otherwise coated to provide corrosion protection, of aluminum or of moulded or extruded plastics material.

If required, the vapour barrier facings 21 and 36 may be provided with light reflective surfaces, which may be embossed.

This will be readily apparent to those skilled in the art, various other modifications may be made within the scope of the invention as defined by the following claims.

The embodiments of the invention in which an exclusive property or privilege is claimed are defined as follows:

1. A metal building insulation system, comprising:

elongate metal structural members of a building frame spaced apart from one another in mutually parallel relationship;

said structural members each having a flange at the outermost sides of the respective structural member;

said flanges each having an outer face directed outwardly of said building frame;

at least one layer of heat insulating material extending between said structural members; and means for retaining said heat insulating layer relative to said structural member, said retaining means comprising:

(a) a channel member overlying said flanges of each of said structural members and having an intermediate portion located outwardly of and extending across respective ones of said outer faces, a pair of side walls projecting inwardly from opposite longitudinal sides of said intermediate portion and a retainer projection extending laterally of the respective structural member from one of said side walls and located inwardly of said heat insulating layer; and (b) an additional flange facing inwardly of the building frame from the innermost sides of each of said structural members, said additional flange projecting laterally of the respective structural member at the side thereof opposite from the respective retainer projection, whereby said heat insulating layer is retained by said additional flange and by said retainer projection at the opposite sides of said structural member.

2. A metal building insulation system as claimed in claim 1 wherein said one of said side walls from which said retainer projection extends laterally of the respective structural member is formed with a longitudinal recess located inwardly of respective ones of said structural member flanges located at the outermost sides of the respective structural members to enable said heat insulating layer to substantially abut the respective structural member.

3. A metal building insulation system as claimed in claim 2 wherein said retainer projections comprise flanges extending longitudinally of said one of said side walls and wherein sealing strips extend along outermost marginal edge portions of said retainer projection flanges.

4. A metal building insulation system as claimed in claim 1, 2, or 3 wherein said additional flange and said retainer projection are substantially coplanar.

5. A metal building insulation system as claimed in claim 1, 2, or 3 wherein said channel members can be installed on said structural members from the exterior of said building frame.

6. A metal building insulation system as claimed in claim 3 wherein said structural members comprise roof purlins and said channel members are fitted over said roof purlins with said intermediate portions seated on said purlins and said side walls depending downwardly along opposite sides of said purlins and wherein said insulation system further includes cladding material secured to and covering said structural members.

7. A metal building insulation system as claimed in claim 6 further including strips of heat insulating material interposed between said intermediate portions and said cladding, said strips of heat insulating material possessing a relatively high compressive strength of at least 30 pounds per square inch at 5% deformation.

8. A metal building insulation system as claimed in claim 7 wherein said layers of heat insulating material have edges facing said side walls, said edges including edge portions extending outwardly beyond said side walls, wherein said strips of heat insulating material are interposed between said edge portions adjacent ones of said layers of heat insulating material.

9. A metal building insulation system as claimed in claim 8 wherein said heat insulating layer comprises panels of bonded semi-rigid glass fiber insulating material having a density of 1.5 to 6.5 pounds per cubic foot and a thickness of 1 to 5 inches.

10. A metal building insulation system as claimed in claim 7 further comprising an additional layer of heat insulating material interposed between said at least one layer and said cladding.

11. A metal building insulation system as claimed in claim 10 wherein said additional insulating layer comprises bonded glass fiber insulating material having a density of 0.40 to 6.5 pcf.

12. A metal building insulation system as claimed in claim 7 wherein said structural members comprise horizontally extending components of a wall.

13. A metal building insulating system as claimed in claim 12 wherein said heat insulating layer is provided with a vapor barrier and strips of vapor barrier material are attached thereto and to said structural members for closing gaps therebetween.

14. A metal building insulation system as claimed in claim 7 wherein said additional layer of insulating material extends outwardly beyond said side walls into proximity with said strips of heat insulating material.

* * * * *